US005478283A

United States Patent [19]

Hoblit

[11] Patent Number: 5,478,283

[45] Date of Patent: Dec. 26, 1995

[54] BOWLING BALL PROPULSION DEVICES

[76] Inventor: E. Harold Hoblit, 80 S. Becker, New Lebanon, Ohio 45345-9705

[21] Appl. No.: 271,526

[22] Filed: Jul. 7, 1994

[51] Int. Cl.[6] ..... A63D 5/00

[52] U.S. Cl. ..... 473/56; 273/129 L; 473/107

[58] Field of Search ..... 473/55, 56, 59, 473/60, 106, 107; 273/118 R, 119 R, 67 R, 129 R, 129 L, 129 M; 124/79; 446/450, 451, 452, 453

[56] References Cited

U.S. PATENT DOCUMENTS 2,263,602 11/1941 Whittle ..... 273/129 M
3,228,693 1/1966 Ingebo ..... 273/129 M
4,470,598 9/1984 Steele et al. ..... 473/56
5,271,619 12/1993 Caminiti ..... 473/56
5,333,867 8/1994 DiVito ..... 273/129 M

*Primary Examiner*—Vincent Millin
*Assistant Examiner*—William M. Pierce
*Attorney, Agent, or Firm*—Donald P. Gillette

[57] ABSTRACT

A bowling ball propulsion device including a frame that has a rear member to push a bowling ball forward in rolling engagement with the surface of a bowling lane and has two side members extending forward from the rear member. The side members are spaced apart far enough to embrace a bowling ball and to engage it only along opposite diametrical points. The frame is supported above the surface of the bowling lane by supports at the rear of the frame to permit the forward ends of the side members to be tipped down or up to control engagement of the frame with a bowling ball.

9 Claims, 2 Drawing Sheets

FIG. 1
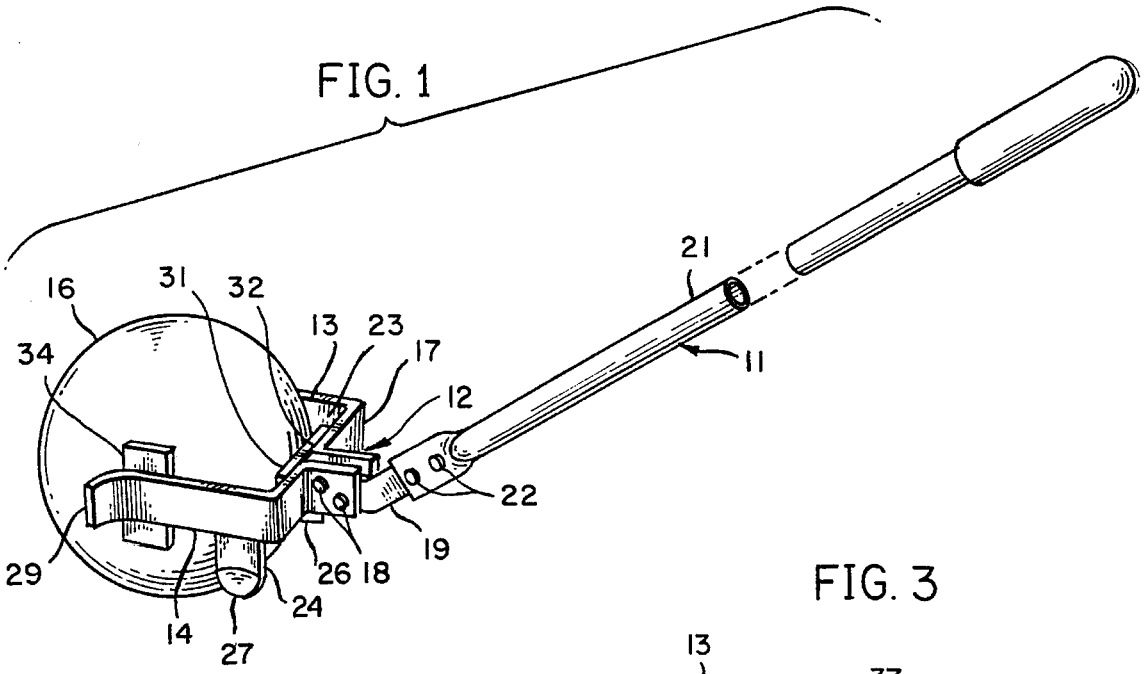
FIG. 3
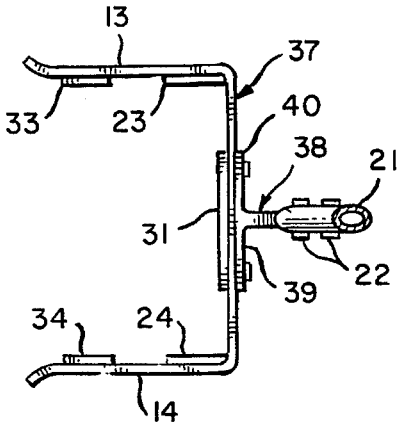
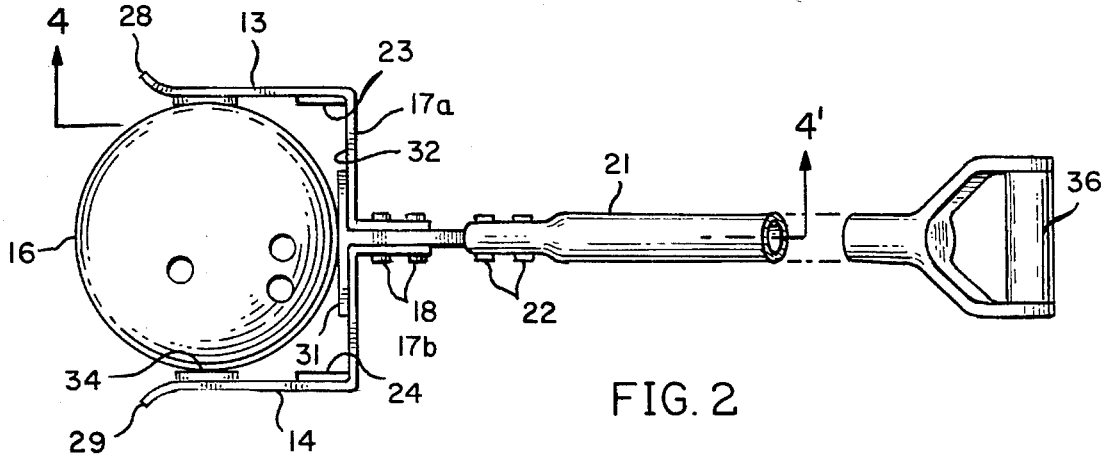
FIG. 2

BOWLING BALL PROPULSION DEVICES

BACKGROUND OF THE INVENTION

1. Field of the Invention

This invention relates to the field of bowling and particularly to a device by which the ball may be propelled to cause it to roll along a bowling lane toward an array of pins.

2. The Prior Art

In propelling a bowling ball along a lane, it is normal for the bowler to start by holding the ball in front and fairly high while beginning to take a series of steps along an approach section toward the head section of the lane. Simultaneously with that foot movement, the bowler swings the ball down and back in an arc while straightening the arm, and then swings the ball forward, finally letting it go at a low point just before the bowler's forward foot reaches the foul line that marks the end of the approach section and the beginning of the head section of the lane so that the ball can roll along the lane toward the pins. This combination of movements requires some dexterity and an amount of strength that depends on the weight of the ball. In tenpins, which is the most popular form of bowling, the ball may weigh up to 16 pounds and may have a circumference as great as 27", making it necessary to form at least two, and usually three, spaced holes in the ball to receive the bowler's thumb and at least one finger to grasp the ball firmly enough to pick it up and swing it.

While the holes make it possible for a bowler to lift the ball with one hand and to swing it in order to give it the desired momentum along a precise path toward the pins, it is desirable that the propelling force applied to the ball not include an upward component, referred to as lofting the ball, that would cause the ball to land with a crash on the head section, since the impact of the heavy ball might do some damage to the surface of that section. The head section normally receives more damage than other parts of a lane for this very reason.

The movements normally executed by a bowler are not required by the rules of the game. All that is required is that only the ball touch the lane beyond the foul line and proceed along the lane toward the pins. The score is calculated according to the number of pins knocked over and the number of throws required to do so. While the number of pins knocked over by one throw of the ball may be greater if the ball is thrown hard, causing each pin that is directly hit to fly away from the impact and knock over several others, it is possible to knock over just as many pins by rolling the ball less energetically and depending on the accuracy of the throw to strike some of the pins at the correct angle to cause them to strike others in directions that would cause all of them to fall down. The present invention makes use of that fact.

People whose physical ability to impart great momentum to the ball, or even to lift it, has been adversely affected due to injury or any other reason may still be intensely interested in bowling, and several devices have been conceived to allow them to do so.

One such device is the ball projector of Gorsuch shown in his U.S. Pat. No. 2,432,570, but that device has a rod bent into a U-shape that is closed at the front and fits over the ball and is intended to hold the ball in several different positions. In order to be able to hold the ball in those positions, the rod has side rods spaced apart by a distance less than the diameter of the ball. When the device is in a position to project the ball, the side rods rest on the ball above its horizontal central plane, i.e., the plane that passes through the center of the ball and is parallel to the flat surface of the lane, thereby creating a frictional drag that impedes rotation of the ball and may give it a sideways impetus.

In U.S. Pat. No. 2,263,602, Whittle shows a complex device for imparting rotational motion to the ball by means of a number of wheels mounted on a member that supports the ball above the floor and, therefore, must drop the ball on the surface of the bowling lane as the ball is released to proceed toward the pins.

The U.S. Pat. No. Des. 275,982 of Heijligers shows a bowling ball pusher that has a U-shaped frame formed of curved pipes and junctions supported on short legs that are located at the free ends of the U. These legs and have swiveling rollers at their own lower ends. There is no suggestion of the closeness of fit of the ball in the U-shaped portion, nor is there any suggestion of low-friction surfaces to allow the ball freedom to build up unhindered rolling motion as it is pushed forward. In addition, the short front legs apparently would cause the device to make contact with the ball below the central plane parallel to the floor, and the swivel mounting of the wheels would allow them to move sideways as well as forward when the device was being pushed.

Swanson shows another U-shaped projector in U.S. Pat. No. 3,145,840. The juxtaposed sides of Swanson's projector not only rest on the surface of the approach section but also hold the ball above that surface. In the embodiment in his FIGS. 1 and 2, the ball is significantly wider than the space between the sides so the sides contact the ball below its central plane parallel to the floor. The ball is not well-controlled the structure of FIGS. 1 and 2, but at least the ball would not be wedged between the sides as it would be in the embodiment in his FIGS. 3 and 4. In both embodiments, the fact that the entire lower surfaces of the sides of the U-shaped projector slide along the surface of the lane prevents the handle from being tilted up or down according to the wishes of the bowler.

The U.S. Pat. No. 3,228,693 of Inegro shows a ball-handling implement that has a band that encircles the ball and must be lifted by operation of a triggering mechanism when the ball is to be released to roll down the lane. This adds an unnecessary complexity to the implement.

Other U.S. Patents relevant to the propulsion of a ball or a puck are: U.S. Pat. Nos. 2,567,313 to Bailey; 3,033,567 to Raab; 3,206,202 to Evans; and 3,215,436 to Carter.

OBJECTS AND SUMMARY OF THE INVENTION

It is an object of this invention to provide a bowling ball propulsion device that can direct the ball accurately along a bowling lane and does not require elevating the ball above floor level in order to propel it.

Another object is to provide a bowling ball propulsion device that can be used by a bowler either in standing or sitting position.

Another object is to provide a bowling ball propulsion device with a rear handle that can be held at any convenient height by a bowler in imparting force to the bowling ball.

Those who are skilled in the technology with which this invention deals will recognize further objects after studying the following description.

A bowling ball propulsion device in accordance with this invention comprises a U-shaped frame, which is open at the front and is defined by side members and a rear member connected to the side members. The side members have low-friction, juxtaposed surfaces spaced apart by a distance slightly less than the diameter of a bowling ball to engage and guide opposite sides of the ball. The low-friction surfaces extend along at least a portion of each side member and the rear member where those members would or might contact the ball, such points of contact being along a central plane of the ball. The side members have enough resilience so that their low-friction surfaces impose only very light pressure on opposite sides of the ball. A handle extends backwardly and upwardly away from the frame to allow a player using the device to do so from any convenient position, such as standing up or sitting down. Support means are provided on opposite sides of the frame to support the lower surface of the frame above the bowling lane surface by a distance such that the low-friction surfaces on the frame engage the central plane of the ball parallel to the floor. In referring to the surfaces of the frame as being low-friction surfaces, what is meant is that the total amount of drag imposed on the sides and rear of the ball by those surfaces is less than the rolling friction of the ball on the surface of the approach section, whereby the ball is able to roll freely as it is pushed along the approach section by the frame in gathering momentum on a path toward the pins.

Since the support means move in contact with the surface of the approach section as the propulsion device is pushed forward, at least the lowermost surfaces of the support means are also provided with low-friction means to make low-friction engagement with the surface of the approach section.

The invention will be described in greater detail in connection with the drawings, in which like reference numbers in different figures indicate the same item.

BRIEF DESCRIPTION OF THE DRAWINGS

FIG. 1 is a perspective view of a bowling ball propulsion device according to this invention.

FIG. 2 is a top view of a propulsion device substantially like that in FIG. 1.

FIG. 3 is a top view of the frame of an alternative embodiment of the propulsion device.

DETAILED DESCRIPTION OF A PREFERRED EMBODIMENT

Figure 4:
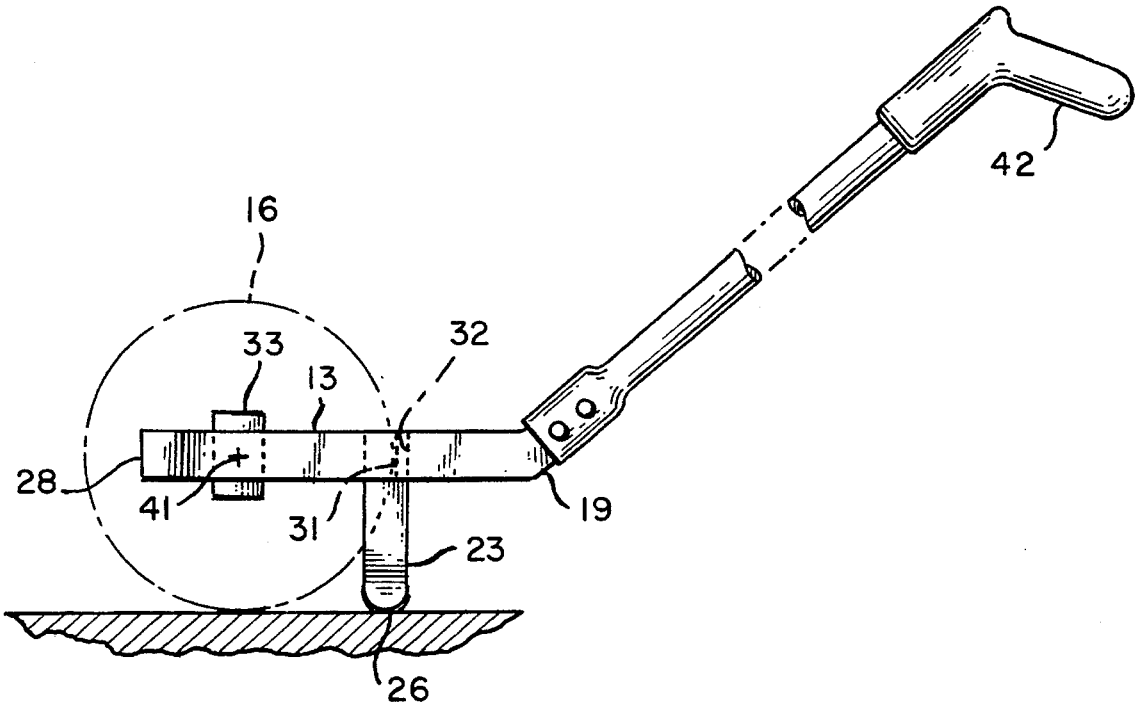
FIG. 4 is a cross-sectional view of a fragment of the frame of the propulsion device substantially like that in FIG. 1, the parting plane for the cross section being along the line 4—4' in FIG. 2.

FIG. 1 shows a bowling propulsion device 11 that has a U-shaped frame 12 comprising two parallel side members 13 and 14, which are spaced apart by a distance approximately equal to the diameter of a bowling ball 16, and a rear member 17 connected to the side members. The latter is securely attached by bolts 18, or any other suitable means, to opposite sides of a bracket 19, The bracket supports a handle 21 that is secured to the bracket in this embodiment by a pair of bolts 22 and extends upward and backward at an angle to the frame 12.

Supports in the form of legs 23 and 24 are rigidly attached to the side members 13 and 14, respectively, near the rear ends of the side members where they join the outer ends of the rear member 17. The bottom ends of the supports 23 and 24 comprise low-friction means 26 and 27, respectively, to allow the legs to slide smoothly along the surface of the approach section of the bowling lane without scarring it as the propulsion device 11 is being thrust forward to impart momentum to the ball 16 in a direction guided by the front surface of the rear member 17 and the side members 13 and 14.

The top view of the propulsion device 11 in FIG. 2 shows the rear member 17 as being divided into two mirror-image parts 17*a* and 17*b* with side member 13 extending perpendicularly forward from the outer end of one part 17*a* and the side member 14 extending perpendicularly forward from the outer end of the other part 17*b*. In this embodiment, each of the parts 17*a* and 17*b* and its respective side member 13 and 14 is formed of a single aluminum bar, and both side members 13 and 14 are curved outward at their free, or front, ends 28 and 29 to facilitate sliding the frame into place embracing the ball 16. A satisfactory cross-sectional size for the bar is about 1"×⅛", with the 1" dimension being in the vertical direction of the frame 12 in FIG. 1.

A slab, or pad, 31 of low-friction material, such as nylon, is attached to the forward-facing surface 32 of the central part of the rear member 17 to serve as a low-friction surface of the rear member so that, as the ball is pushed by the rear member, the ball can rotate freely along the lane. While the material 31 is referred to herein as a pad, it should be understood that that term does not indicate that it has any particular thickness. It may, in fact, be merely a thin coating or no coating at all if the forward surface of the rear member constitutes a low-friction material. As a result, the pad 31 may be thought of simply as a low-friction surface. Similar pads 33 and 34 of low-friction material, such as nylon, are attached to juxtaposed surfaces of the side members 13 and 14, respectively, to provide flat, parallel, low-friction surfaces near the free ends 28 and 29. The perpendicular distance between the juxtaposed surfaces of these low-friction surfaces is approximately 8½", which is less than 0.1" less than the maximum allowable diameter of a regulation bowling ball for tenpins. This permits the ball 16 to be guided by these low-friction surfaces without having the rotation of the ball impeded.

If the propulsion device is to be used for other bowling games, the distance between the low-friction surfaces 33 and 34 along the side members may be chosen according to the diameter of the balls used in such bowling games.

Since the low-friction surfaces 33 and 34 are to engage diametrically opposite parts of the ball 16, they must be located ahead of the low-friction surface 31 by a distance approximately equal to the radius of the ball, i.e., approximately 4¼". However, it is neither necessary nor desirable that the surfaces 33 and 34 make pinpoint contact with opposite sides of the ball 16. On the contrary, it is desirable that the surfaces 33 and 34 extend both up and down and forward and to the rear from the precise point of contact with the ball, and suitable dimensions for the surfaces 33 and 34 are approximately 2" in height and 1" in width in this embodiment. It is to be understood, of course, that these dimensions, like all dimensions stated herein, are illustrative of a preferred embodiment, but the invention is not limited to these dimensions. Pads 33 and 34 of these dimensions can make contact with diametrically opposite parts of the ball 16 even if the frame 12 is tilted due to having the bowler raise or lower the handle from the position in which the frame would be precisely parallel with the surface of the approach section.

The handle 21 illustrated in FIG. 2 is shown as having a transverse grip 36. While such a grip is easier for some people to hold, other forms of grips may be used, instead, including a simple rounded end on the handle shown in FIG. 1.

FIG. 3 is a top view of only the central part of a modified frame 37 that is very similar to the frame 12 in FIG. 2 except that the rear member 17 and both side members 13 and 14 are formed of a single bar of material. In the embodiment in FIG. 3, the handle 21 is attached to the rear member by bracket means 38 having two ends 39 and 40 spread apart to lie against and be rigidly attached to the rear surface of the member 17.

FIG. 4 shows the inner surface of the side member 13 that faces the member 14. The ball 16 is shown in broken lines to illustrate its position relative to the low-friction surfaces 31 and 33. The surface 31 is shown in this embodiment as having a vertical dimension approximately equal to that of the rear member 17, while the surface 33 is shown as having a vertical dimension about twice as great as that of the side member 13 on which it is located, although it is within the scope of this invention for the vertical dimension of these low friction surfaces 31 and 33 to be greater or less than the vertical dimension of the respective members 17 and 13. Furthermore, it is not necessary that the vertical dimension, nor, for that matter, the thickness, of the member 13 be equal to corresponding dimensions of the member 17.

The nominal point of contact of the ball 16 with the surface 33 is indicated by a cross 41 when the frame 12 is horizontal, i.e., when the support 23 is vertical. With the support 23 (and the support 24 on the member 14, as shown in FIG. 1) near the junction of the respective side member with the rear member 17, the frame can be tilted farther without moving the surface 33 (and the corresponding surface 34) out of contact with the ball 16 than if the supports were located closer to the free ends of the side members. In addition, the low-friction surface 31 continues to engage the ball at about the same location, even if the frame is pivoted about the bottom point of the low-friction surface 26 on the bottom end of the support 23 (and the corresponding point of the low-friction surface 27 of the support 24).

FIG. 4 shows a different configuration of hand grip 42 than in the embodiment in FIG. 1 or FIG. 2. In FIG. 4, the hand grip 42 extends downwardly from the main part of the handle 21 and is referred to as a pistol grip.

Figure 5:
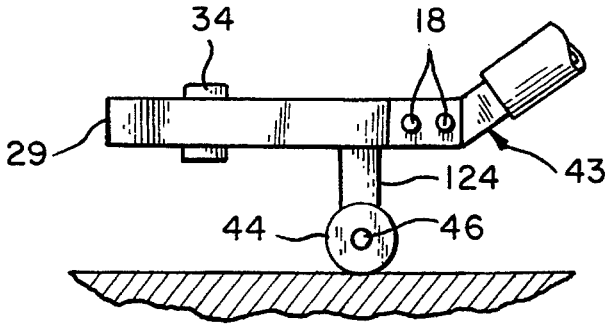
FIG. 5 is a side view of another embodiment of the invention.

FIG. 5 shows a side view of another embodiment 43 of the invention that differs from the previous embodiments in having a wheel rotatably mounted on each of the two supports that correspond to the supports 23 and 24 in the previous embodiments. Only one of the supports, which is identified by reference numeral 124 and corresponds to the support 24 in the previous figures, is visible in FIG. 5. A similar support that corresponds to support 23 in previous figures is directly behind it. Only one of the wheels, identified by reference numeral 44 is visible in FIG. 5; the other wheel on the support hidden by the support 124 is hidden by the wheel 43. Both of these wheels rotate on a fixed axis 46 perpendicular to the side members 13 and 14 and serve as low-friction surfaces that allow the frame 12 to be moved back and forth substantially only in one direction. The rolling friction of these wheels is very low in that direction and is much higher in the perpendicular direction, which helps the bowler to maintain a proper direction of movement of the device 43 along the approach section of the bowling lane as the ball 16 is accelerated toward pins located at the far end of the bowling lane. In this embodiment the wheels have a diameter less than half that of the ball 16.

The invention has been described in terms of a specific embodiment, but it will be apparent to those skilled in the technology with which this invention deals that the concept may be embodied in other forms without departing from the true scope of the invention.

What is claimed is:

1. A bowling ball propulsion device to roll a bowling ball substantially longitudinally along a bowling lane surface and in rolling engagement therewith toward a pin location, the device comprising:

(a) a frame having a lower surface and comprising:

(i) a rear member having a central part with forward-facing engagement surface means to be pushed against the ball to establish sliding contact therewith while causing the ball to roll forward in rolling contact with the bowling lane surface, and (ii) side members connected to the rear member and extending forwardly therefrom to forward ends of the side members, the side members being spaced apart by a distance slightly greater than the diameter of a bowling ball and having parallel, juxtaposed guide surfaces near the forward ends thereof, the guide surfaces being perpendicular to the surface of the bowling lane and being located forward of the engagement surface means of the rear member to engage diametrically opposite sides of a bowling ball, whereby only the ball-confronting surfaces and the forward-facing surface touch the ball and only on a common central plane of the ball in propelling the ball forward and guiding the ball;

(b) handle means attached to the frame and extending in a direction generally backwardly and upwardly relative to the frame; and (c) support means, rigidly connected to the frame and having lowermost surfaces adapted to move smoothly along a bowling lane surface, for holding the lower surface of the frame above a bowling lane surface and for placing the forward-facing surface means on the central part of the rear member at a height above the bowling lane surface approximately equal to a radius of a bowling ball.

2. The bowling ball propulsion device of claim 1 in which the support means comprise legs rigidly attached to the side members and having lower ends.

3. The bowling ball propulsion device of claim 2 in which the legs have a low-friction means on lower ends thereof, such that the legs slide smoothly along the surface of the approach section of the bowling lane without scarring it.

4. The bowling ball propulsion device of claim 1 in which the rear member is straight and the side members extend perpendicularly thereto at opposite ends of the rear member, each of the side members thereby forming a respective corner intersection with the rear member.

5. The bowling ball propulsion device of claim 1 in which each of the support means comprises a wheel having a fixed plane of rotation parallel to the side members, the wheels having surfaces forming the lowermost surfaces for rolling engagement with the bowling lane surface when moving generally longitudinally along the bowling lane surface.

6. The bowling ball propulsion device of claim 1 in which each wheel has a diameter substantially less than a diameter of a bowling ball.

7. The bowling ball propulsion device of claim 1 in which the handle has a grip at its end remote from the frame, the grip extending transversely with respect to the direction from the frame to the grip.

8. A bowling ball propulsion device to roll a bowling ball substantially longitudinally along a bowling lane surface and in rolling engagement therewith toward a pin location, the device comprising:

(a) a frame having a lower surface and comprising:

(i) a straight rear member having a central part with first and second ends and forward-facing engagement surface means to be pushed against a bowling ball to establish sliding contact therewith while causing the ball to roll forward in rolling contact with the bowling lane surface, and (ii) first and second flat side members connected to the first and second ends, respectively, of the rear member and extending forwardly therefrom to forward ends of the side members, the side members being spaced apart by a distance slightly greater than the diameter of a bowling ball and having juxtaposed, flat, guide surfaces parallel to each other on the side members, each of the inwardly facing, guide surfaces having a center located forward of the engagement surface means of the rear member by a distance sufficient to engage diametrically opposite parts of the surface of a bowling ball;

(b) handle means attached to the frame and extending backwardly and upwardly relative to the frame; and (c) support means, rigidly connected to the frame adjacent the side members and having lowermost surfaces adapted to slide smoothly along a bowling lane surface, for supporting the guide surfaces of the side members and the engagement surface means on the central part of the rear member at a height above the bowling lane surface approximately equal to a radius of a bowling ball.

9. The bowling ball propulsion device of claim 8 in which the handle is attached to the rear member and extends therefrom along a plane midway between the side members.

* * * * *